US005916004A

United States Patent [19]

Farnworth

[11] Patent Number: 5,916,004

[45] Date of Patent: Jun. 29, 1999

[54] PHOTOLITHOGRAPHICALLY PRODUCED FLAT PANEL DISPLAY SURFACE PLATE SUPPORT STRUCTURE

[75] Inventor: Warren M. Farnworth, Nampa, Id.

[73] Assignee: Micron Technology, Inc., Boise, Id.

[21] Appl. No.: 08/584,813

[22] Filed: Jan. 11, 1996

[51] Int. Cl.[6] ..... H01J 9/00

[52] U.S. Cl. ..... 445/24

[58] Field of Search ..... 445/24, 25; 313/309, 313/495

[56] References Cited

U.S. PATENT DOCUMENTS

| | | | |
|---|---|---|---|
| 3,424,909 | 1/1969 | Rougeot | 250/207 |
| 3,979,621 | 9/1976 | Yates | 313/105 CM |
| 3,990,874 | 11/1976 | Schulman | 65/4 B |
| 4,091,305 | 5/1978 | Poley et al. | 313/220 |
| 4,183,125 | 1/1980 | Meyer et al. | 29/25.15 |
| 4,193,226 | 3/1980 | Gill, Jr. et al. | 51/124 |
| 4,451,759 | 5/1984 | Heynisch | 313/495 |
| 4,705,205 | 11/1987 | Allen | 228/180.2 |
| 4,811,522 | 3/1989 | Gill, Jr. | 51/131.1 |
| 4,923,421 | 5/1990 | Brodie et al. | 44/24 |
| 4,940,916 | 7/1990 | Borel et al. | 313/306 |
| 5,063,327 | 11/1991 | Brodie et al. | 313/482 |
| 5,070,282 | 12/1991 | Epszstein | 315/383 |
| 5,136,764 | 8/1992 | Vasquez | 29/25.01 |
| 5,151,061 | 9/1992 | Sandhu | 445/24 |
| 5,186,670 | 2/1993 | Doan et al. | 445/24 |
| 5,205,770 | 4/1993 | Lowrey et al. | 445/24 |
| 5,229,691 | 7/1993 | Shichao et al. | 315/366 |
| 5,232,549 | 8/1993 | Cathey et al. | 456/633 |
| 5,247,133 | 9/1993 | Wiemann et al. | 174/17 |
| 5,259,799 | 11/1993 | Doan et al. | 445/24 |
| 5,324,602 | 6/1994 | Inada et al. | 430/23 |
| 5,329,207 | 7/1994 | Cathey et al. | 315/169.1 |
| 5,342,477 | 8/1994 | Cathey | 156/643 |
| 5,342,737 | 8/1994 | Georger, Jr. et al. | 430/324 |
| 5,347,292 | 9/1994 | Ge et al. | 345/74 |
| 5,357,172 | 10/1994 | Lee et al. | 315/167 |
| 5,358,601 | 10/1994 | Cathey | 156/656 |
| 5,358,908 | 10/1994 | Reinberg et al. | 437/228 |
| 5,359,256 | 10/1994 | Gray | 313/169 |
| 5,371,433 | 12/1994 | Home et al. | 313/495 |
| 5,372,901 | 12/1994 | Rolfson et al. | 430/5 |
| 5,372,973 | 12/1994 | Doan et al. | 437/228 |
| 5,374,868 | 12/1994 | Tjaden et al. | 313/310 |
| 5,387,844 | 2/1995 | Browning | 315/169 |
| 5,391,259 | 2/1995 | Cathey et al. | 156/643 |
| 5,410,218 | 4/1995 | Hush | 315/169 |
| 5,413,513 | 5/1995 | Horne et al. | 445/24 |
| 5,438,240 | 8/1995 | Cathey et al. | 315/169 |
| 5,445,550 | 8/1995 | Xie et al. | 445/24 |
| 5,448,131 | 9/1995 | Taylor et al. | 313/309 |
| 5,449,970 | 9/1995 | Kumar et al. | 313/495 |
| 5,486,126 | 1/1996 | Cathey et al. | 445/25 |
| 5,526,151 | 6/1996 | Miyazaki et al. | 445/24 X |
| 5,704,820 | 1/1998 | Chandross et al. | 445/24 |

FOREIGN PATENT DOCUMENTS

| | | | |
|---|---|---|---|
| 0690472 A1 | 1/1996 | European Pat. Off. . | |
| 2-165540 | 6/1990 | Japan . | |
| 127429 | 5/1991 | Japan | 445/24 |
| 3-179630 | 5/1991 | Japan . | |

*Primary Examiner*—Kenneth Ramsey
*Attorney, Agent, or Firm*—Hale and Dorr LLP

[57] ABSTRACT

Fabrication of support structures for use in field emitter displays through a photolithographic process that involves (1) depositing a photolithable material on a substrate, (2) etching the material to create column areas in the material, (3) filling the column areas with a support material, (4) planarizing the support material, photolithable material, and the filled column areas to the desired height, and (5) removing the remaining photolithable material by exposing the filled column areas as support structures on the substrate.

6 Claims, 3 Drawing Sheets

PHOTOLITHOGRAPHICALLY PRODUCED FLAT PANEL DISPLAY SURFACE PLATE SUPPORT STRUCTURE

BACKGROUND OF THE INVENTION

1. Field of the Invention

This invention relates to high aspect ratio microstructures, and field emission devices using such microstructures as spacers. More particularly, this invention relates to processes for creating support structures that provide support for a flat panel display against the atmospheric pressure on the display screen without impairing the resolution of the display's image.

2. Description of the Related Art

Cathode ray tube (CRT) displays, as used in desk top computer screens, function as a result of a scanning electron beam from an electron gun impinging on a pixel's phosphors of a display screen. The electrons from the beam thus increase the energy level of the pixel's phosphors. When the phosphors return to their normal energy level, the phosphors release photons through the glass screen of the display to the viewer. Flat panel displays (e.g., as seen in U.S. Pat. Nos. 5,410,218, 5,391,259, 5,387,844, 5,374,868, 5,372,901, 5,372,973, 5,358,908, 5,358,601, 5,359,256, 5,357,172, 5,342,477, 5,329,207, 5,259,799, 5,186,670, 5,151,061, 5,070,282, improve on CRTs by combining the cathodoluminescent-phosphor technology of CRTs with integrated circuit technology to create a thin, high resolution display where each pixel has its own electron beam (or emitter). This type of display technology is becoming increasingly important in today's computer industry.

A relatively high voltage differential (e.g., generally above 200 volts) exists between the cathode surface (also known as base electrode, baseplate, emitter surface, cathode electron emitting surface) and the display screen (also known as an anode, cathodoluminescent screen, faceplate, or display electrode). Electrical breakdown between the cathode surface and the display screen must be prevented to maintain operation of the display. At the same time, the narrow spacing between the two is necessary to maintain the desired structural thinness and to obtain high image resolution. Further, the spacing must be uniform for consistent image resolution and brightness to avoid display distortion. Uneven spacing is much more likely to occur, however, due to the high pressure differential that exists between the external atmospheric pressure and the pressure within the evacuated chamber between the cathode surface and the display screen.

Support structures (or spacers) placed between the cathode surface and the display screen prevent uneven spacing by maintaining the required constant spacing. To be effective, the support structures must meet the following requirements: (1) be sufficiently non-conductive to prevent electrical breakdown between the cathode surface and the display screen, in spite of the close spacing (on the order of 100 microns) and relatively high voltage differential (200V or more), (2) exhibit mechanical strength such that they exhibit only slow deformation over time, providing the flat panel display with an appreciable useful life, (3) exhibit stability under electron bombardment, since electrons will be generated at each of the pixels, (4) be capable of withstanding "bakeout" temperatures of around 400° C., necessary to create the high vacuum between the cathode surface and backplate of the display screen, and (5) be small enough in size so as to not to visibly interfere with display operation.

There exist various processes for avoiding the pressure problems mentioned above, such as, for example the following U.S. patents, all of which are incorporated herein by reference:

- U.S. Pat. No. 5,247,133 entitled "High-Vacuum Substrate Enclosure"
- U.S. Pat. No. 5,205,790 entitled "Method to Form High Aspect Ratio Supports (Spacers) for Field Emission Display Using Micro-Saw Technology"
- U.S. Pat. No. 5,342,737 entitled "High Aspect Ratio Metal Microstructures and Method for Preparing the Same"
- U.S. Pat. No. 5,232,549 entitled "Spacers for Field Emission Display Fabricated via Self-Aligned High Energy Ablation"
- U.S. Pat. No. 4,923,421, entitled "Method for Providing Polyamide Spacers In a Field Emission Panel Display"

There are several drawbacks to the spacers and methods described in the above cited patents. One disadvantage is that the cost of manufacturing is relatively high when compared to using a photolithographic process as in the present invention.

SUMMARY OF THE INVENTION

The above disadvantages are addressed according to one aspect of the present invention by a process for the formation of FED support structures. According to one example, the process comprises: depositing a first material on a substrate; generating column areas in the first material, whereby exposed portions of the substrate are defined; depositing a second material in said column areas; planarizing said second material to a desired height; and removing said first material.

DESCRIPTION OF THE DRAWINGS

For a more complete understanding of the present invention and for further advantages thereof, reference is made to the following Description of Embodiments of the Invention taken in conjunction with the accompanying Drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EXAMPLE EMBODIMENTS OF THE INVENTION

Figure 1:
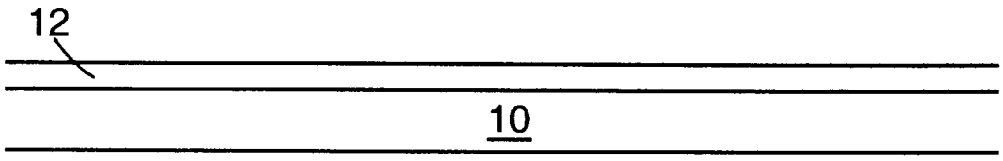
FIG. 1 is a cross-section of a structure useful according to an embodiment of the invention.
Figure 2:
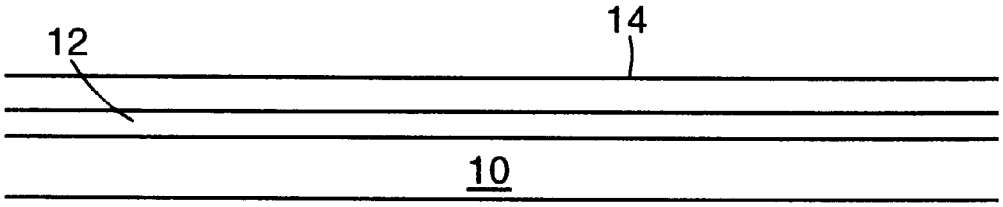
FIG. 2 is a cross-section of a structure useful according to an embodiment of the invention.
Figure 3:
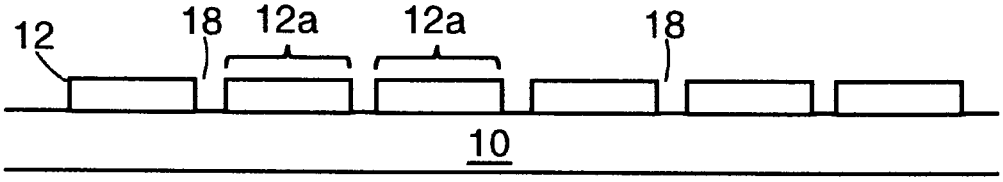
FIG. 3 is a cross-section of a structure useful according to an embodiment of the invention.

Referring to FIG. 1, an example process fabrication of support structures begins with the deposition of a photolithable material 12 (e.g. resist) on to a suitable substrate 10, (for example, a silicon wafer or glass). The next step in the process, FIG. 2, involves depositing another layer 14 of photolithable material that selectively exposes the first layer of photolithable material 12. After removing the second layer of photolithable material 14 in FIG. 3, the selective exposure of the photolithable material 12 creates, perpendicular to substrate 10, column areas 18 within the layer. After the manufacturing process, the column areas 18 will form the support structures.

Figure 4:
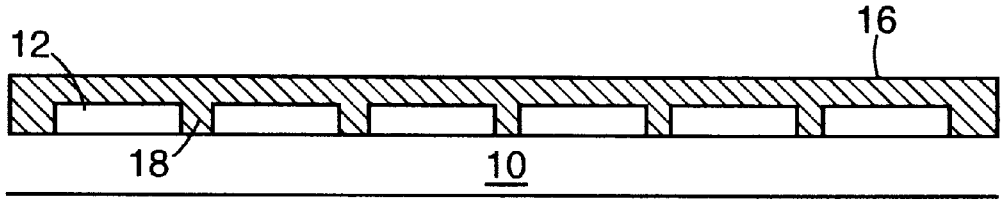
FIG. 4 is a cross-section of a structure useful according to an embodiment of the invention.
Figure 5:
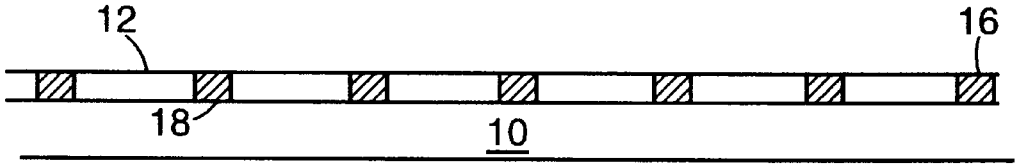
FIG. 5 is a cross-section of a structure useful according to an embodiment of the invention.

Referring now to FIG. 4, the next step in the process involves depositing a layer of support material 16 into the column areas 18. Examples of acceptable support materials include polyamide, silicon nitride, KAPTON (polyimide), and other suitable material. According to the next step of this embodiment, FIG. 5, excess material 16 is removed, for example, by chemical mechanical planarization (CMP), chemical mechanical polishing, or other suitable removal methods. According to another example, an etch, which would react with material 16, while not reacting with material 12 would also be acceptable. In general, CMP involves holding or rotating a wafer of semiconductor material against a wetted polishing surface under controlled chemical slurry, pressure, and temperature conditions. A chemical slurry containing a polishing agent such as alumina or silica may be utilized as the abrasive medium. Additionally, the chemical slurry may contain chemical etchants. This procedure may be used to produce a surface with a desired endpoint or thickness, which also has a polished and planarized surface. Examples of such an apparatus for polishing are disclosed in U.S. Pat. Nos. 4,193,226 and 4,811,522, and both patents are incorporated by reference. Another such apparatus is manufactured by Westech Engineering and is designated as a Model 372 Polisher. The CMP process removes the extraneous support material and planarizes the photolithable material 12 and the column areas 18 to the desired height.

Figure 6:
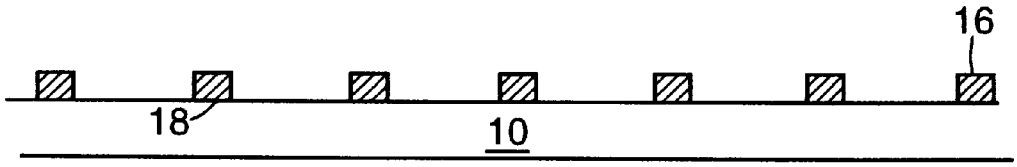
FIG. 6 is a cross-section of a structure useful according to an embodiment of the invention.

The last step of the process, FIG. 6, involves removing the remaining photolithable material 12 (FIG. 5) by a suitable process (for example, rinsing, etching, etc.). The remaining filled column areas 18 form the support structures 16 for the field emitter display.

According to an alternative example embodiment, layer 12 (FIG. 1), comprises a photosensitive material, which is exposed to light to create fixed areas 12*a* (FIG. 3), which are left after the unfixed portions of the photosensitive material is removed. The fixing and removal of unfixed photosensitive material is accomplished in a variety of equally acceptable methods as is known in the art. Further processing to create the columns is accomplished, for example, according to the steps described above.

Figure 7:
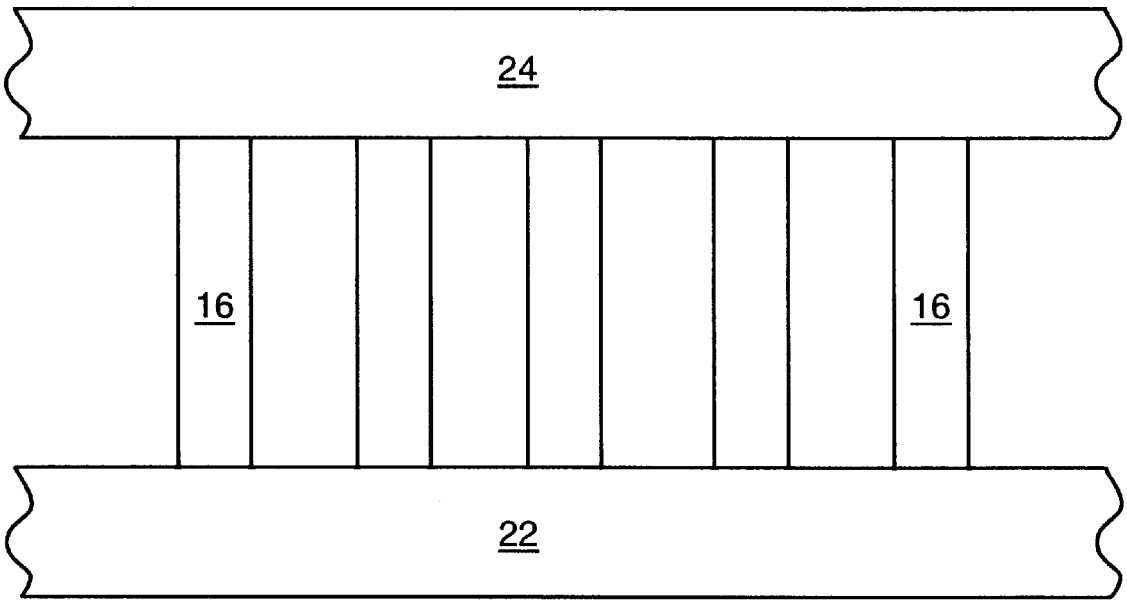
FIG. 7 is a cross-sectional view of an anode, a cathode, and the support structure therebetween.

Refering to FIG. 7, as noted above, such support structures or spacers are placed between the cathode surface and display screen to maintain a constant spacing. In FIG. 7, support structures 16 extending perpendicularly between an anode display screen member 22 and a cathode member 24.

Other embodiments of the invention will be apparent to those skilled in the art after considering this specification or practicing the disclosed invention. The specification and examples above are exemplary only, with the true scope of the invention being indicated by the following claims.

What is claimed is:

1. A process for the formation of FED support structures, the process comprising:

forming a first material on a substrate in a single layer;

forming openings in the first material to expose portions of the substrate;

providing a second material in the openings and over the first material;

removing the second material over the first material to leave the first material with openings and the second material in the openings; and removing the first material to leave columns of the second material where the openings had been formed, the columns extending away from the substrate and being separated from the other columns;

wherein said first material is a photolithable material and forming openings on said first material includes:

providing a resist material over the photolithable first material, exposing the resist to define regions on the photolithable material, and etching the photolithable material.

2. A process as in claim 1 wherein removing some of the second material includes planarizing with chemical mechanical planarization.

3. The method of claim 1, wherein providing a second material includes providing one of polyamide, silicon nitride, and kapton.

4. A method for forming a field emission display (FED) comprising:

forming a single first layer over a first substrate of one of an anode and a cathode of an FED;

forming openings in the single first layer such that the openings extend down to the first substrate;

providing a non-conductive material in the openings and over the single first layer; and removing the single first layer such that the first substrate has posts made of the non-conductive material extending perpendicularly away from the first substrate;

wherein forming openings in the first single layer includes providing a resist material over the first layer, exposing the resist to define regions on the first layer, and etching the first layer.

5. The method of claim 4, further comprising removing the non-conductive material over the single first layer before removing the single first layer.

6. The method of claim 5, wherein the removing includes planarizing with CMP.

* * * * *